US005300940A

United States Patent [19]

Simmons

[11] Patent Number: 5,300,940

[45] Date of Patent: Apr. 5, 1994

[54] BROADBAND ANTENNA

[75] Inventor: Kenneth D. Simmons, Lincoln, Nebr.

[73] Assignee: Centurion International, Inc., Lincoln, Nebr.

[21] Appl. No.: 34,153

[22] Filed: Mar. 22, 1993

Related U.S. Application Data

[63] Continuation of Ser. No. 728,745, Jul. 12, 1991, abandoned.

[51] Int. Cl.[5] ..... H01Q 1/36; H01Q 9/32

[52] U.S. Cl. ..... 343/749; 343/895

[58] Field of Search ..... 343/895, 722, 749, 715; H01Q 1/36, 9/00, 9/32

[56] References Cited

U.S. PATENT DOCUMENTS

| | | | |
|---|---|---|---|
| 3,264,647 | 8/1966 | Nuttle | 343/745 |
| 4,028,704 | 6/1977 | Blass | 343/715 |
| 4,117,493 | 9/1978 | Altmayer | 343/750 |
| 4,730,195 | 3/1988 | Phillips et al. | 343/792 |
| 4,849,767 | 7/1989 | Naitou | 343/895 |

FOREIGN PATENT DOCUMENTS

| | | | |
|---|---|---|---|
| 2046529 | 11/1980 | United Kingdom | 343/715 |

OTHER PUBLICATIONS

DeMaw, "Lightweight Trap Antennas-Some Thoughts", QST, Jun. 1983, pp. 15-18, 343/722.

*Primary Examiner*—Michael C. Wimer

*Attorney, Agent, or Firm*—Zarley, McKee, Thomte, Voorhees & Sease

[57] ABSTRACT

A broadband antenna comprising a connector which is adapted to be connected to a source RF energy having a frequency of 136-174 $MH_z$ or 300-500 $MH_z$. The connector is secured to one end of a hollow housing which encloses a transformer. One end of transformer is connected to the connector while the other end of the transformer is connected to a radiator. The assembly is enclosed in a sheath with cap.

2 Claims, 6 Drawing Sheets

BROADBAND ANTENNA

This is a continuation of copending application Ser. No. 07/728,745 filed on Jul. 12, 1991, now abandoned.

BACKGROUND OF THE INVENTION

Hand-held two-way radios normally broadcast in frequency ranges of 136–174 $MH_z$ (VHF) and 400–500 $MH_z$ (UHF). The present helical antennas employed with the radios are too narrow in band pass to cover the wide frequency range of 136–174 $MH_z$ which requires several different antennas to be manufactured to cover the frequency range. The same is also true for the 400–500 $MH_z$ frequency range. If an antenna is tuned off its resonant frequency in an effort to modify the antenna for a different frequency than that for which it was designed, the impedance thereof rises abruptly. VSWR also rises and radiation efficiency drops.

It is therefore a principal object of the invention to provide a broadband antenna.

A further object of the invention is to provide the broadband antenna capable of being utilized on a two-way radio having a frequency of 136–174 $MH_z$.

Yet another object of the invention is to provide an antenna which may be used with two-way radios having a frequency of 400–500 $MH_z$.

Still another object of the invention is to provide an antenna which may be used with two-way radios having a frequency range of 300–500 $MH_z$.

Yet another object of the invention is to provide an antenna including a connector, an inductor, and a radiator with sheath and cap.

These and other objects of the present invention will be apparent to those skilled in art.

SUMMARY OF THE INVENTION

A broadband antenna is described including a connector which is adapted to be connected to a source of RF energy such as a two-way radio having a predetermined frequency. An inductor interconnects the connector and the antenna radiator which is comprised of a helical wire. The connector, inductor and radiator are enclosed in a suitable sheath and cap. In one form of the antenna, the inductor comprises a ferromagnetic inductor which incorporates a donut-shaped toroid with a single layer coil winding of three turns of two adjacent connectors looped through the toroid core to provide a primary winding and a secondary winding. In another form of the antenna, the toroid is comprised of a powdered iron material which functions as a series resonant circuit. In the inductor of this embodiment, a single looped layer of five turns of the conductor wire makes up the toroid circuit. In still another form of the invention, a powdered iron toroid core is utilized which has four turns of conductor wire wrapped therearound. Two capacitors are utilized to form a broadband tuned circuit.

The donut-shaped toroid provides a highly concentrated electromagnetic flux with current flow to the radiator. The toroid core offers a high inductance to the inductor circuit thus requiring only a few coil turns for a broad bandwidth circuit. The radiator consists of a helical wound coil of steel wire having a wide pitch and which is copper plated which contributes to bandwidth and reduce capacitive reactance. The self-shielding characteristics of the toroid reduces undesired frequencies thus reducing intermodulation and harmonics.

DESCRIPTION OF THE PREFERRED EMBODIMENT

Figure 1:
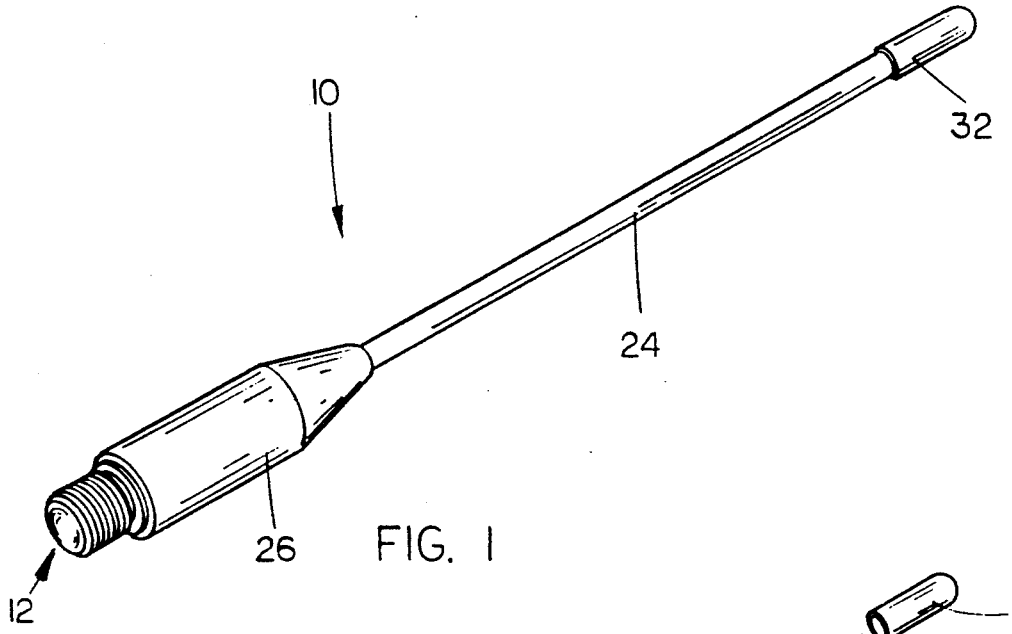
FIG. 1 is a perspective view of one form of antenna.
Figure 2:
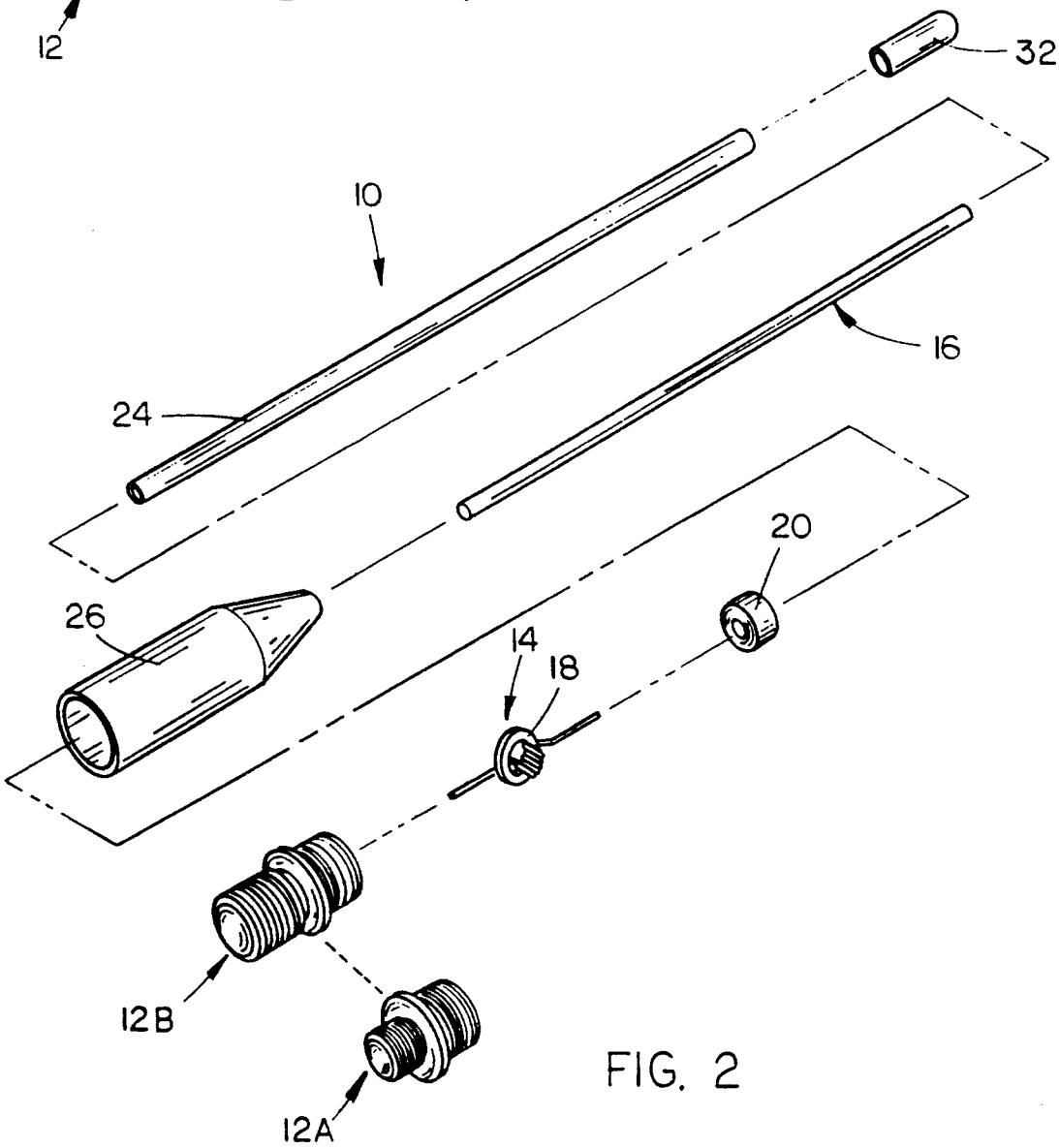
FIG. 2 is an exploded perspective view of the antenna of FIG. 1.
Figure 3:
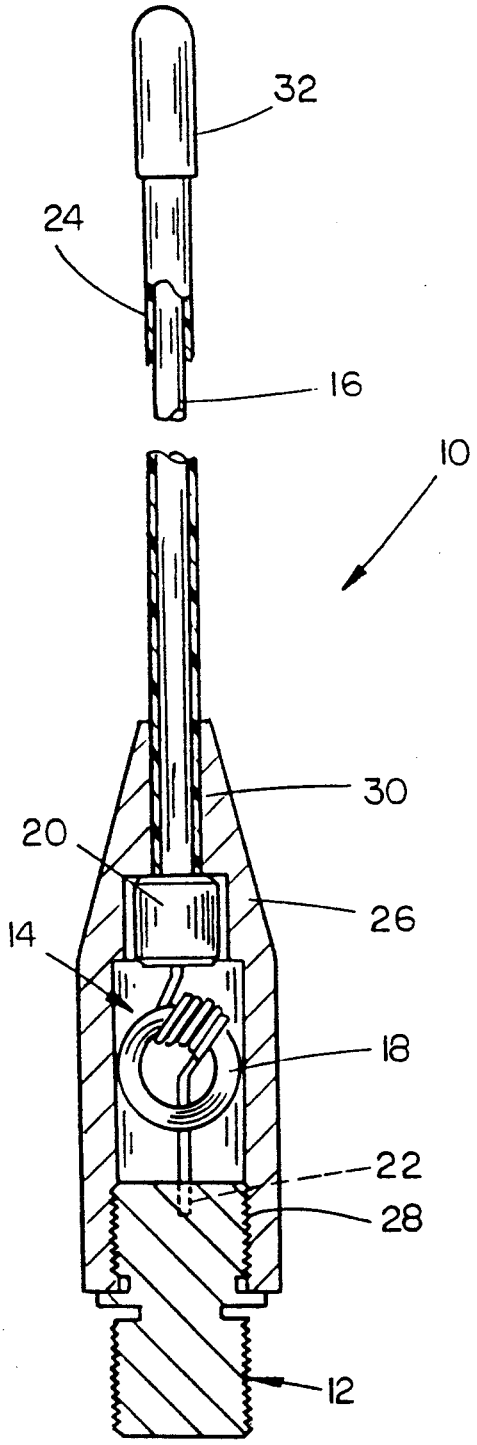
FIG. 3 is a longitudinal sectional view of the antenna of FIG. 1.
Figure 4:
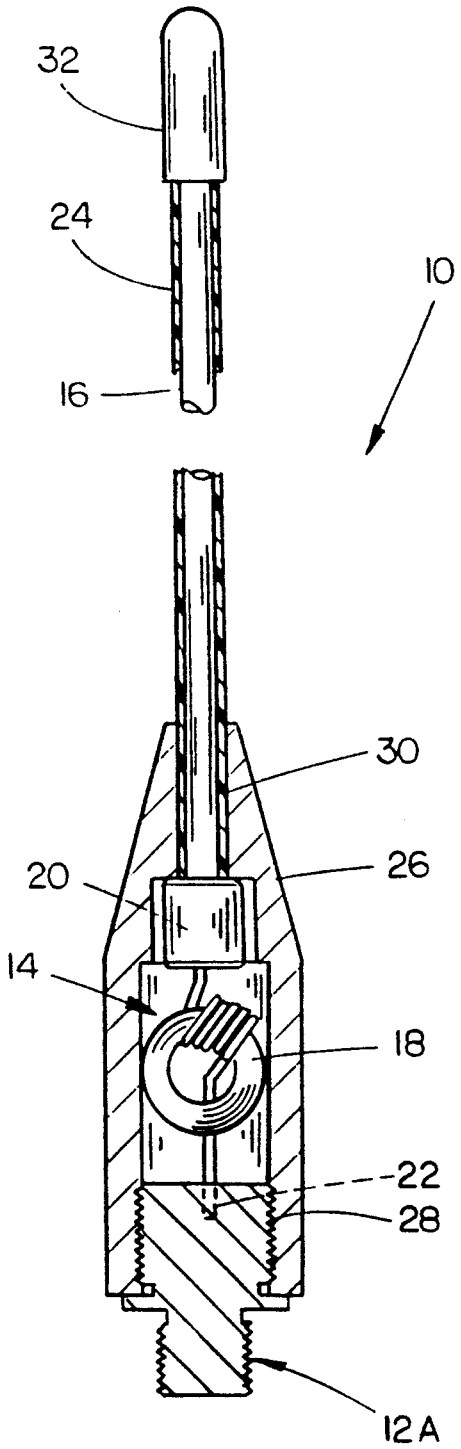
FIG. 4 is a sectional view similar to FIG. 3 except that a different connector is employed.

In FIGS. 1–4, the numeral 10 refers to an antenna suitable for use with radios broadcasting in the 400–500 $MH_z$ frequency range. In FIGS. 1 and 3, the numeral 12 refers to one type of connector which may be utilized with the antenna while the reference numeral **12*a* in FIGS. 2 and 4 refers to a second type of connector which may be used with the antenna. The numeral 12B refers to yet another form of the connector. Connector 12 is comprised of a suitable conductive metal material which is selectively mounted on the radio. Inductor 14 operatively connects connector 12 to the radiator 16**.

Inductor 14 includes an enamel covered No. 26 magnet wire 17 which is looped around the powdered iron toroid core 18. In the particular antenna illustrated in FIGS. 1–4, the wire 17 is looped around the core 18 for five turns as seen in the drawings. One end of wire 17 is stripped of its enamel and is inserted into the opening 22 in the end of the connector 12 and is soldered thereto. The other end of wire 17 is stripped of its enamel and is inserted through the interior of the bushing 20 with the wire then being bent around the outside of the bushing.

The radiator is comprised of a speedometer cable which is enclosed in a sheath 24. The inner end of the sheath 24 has been previously stripped from the inner end of the radiator 16 so that the inner end of the radiator 16 may be received in the core of bushing 20. The bushing 20 is crimped onto the inner end of the radiator 16 with a suitable crimping tool. Plastic sleeve 26 is then slipped over the end of the radiator 16 until the sleeve 26 is in the position of FIG. 3. A suitable bonding agent would have been previously applied to the threaded portion 28 of the connector 12 and in the area referred to generally by the reference numeral 30. Cap 32 is then placed on the end of the sleeve 24 and bonded thereto by a suitable adhesive or the like.

In operation, the connector 12 receives RF energy from a frequency source of 400–500 $MH_z$. The donut-shaped toroid core 18 provides a highly concentrated electromagnetic flux with current flow to the radiator 16. The toroid core 18 offers a high inductance to the circuit thus requiring only a few coil turns for a broad bandwidth circuit. The inductor of FIGS. 1–4 is a broadband inductor with the core selection being governed by physical size, permeability and core mix related to design frequency.

Figure 5:
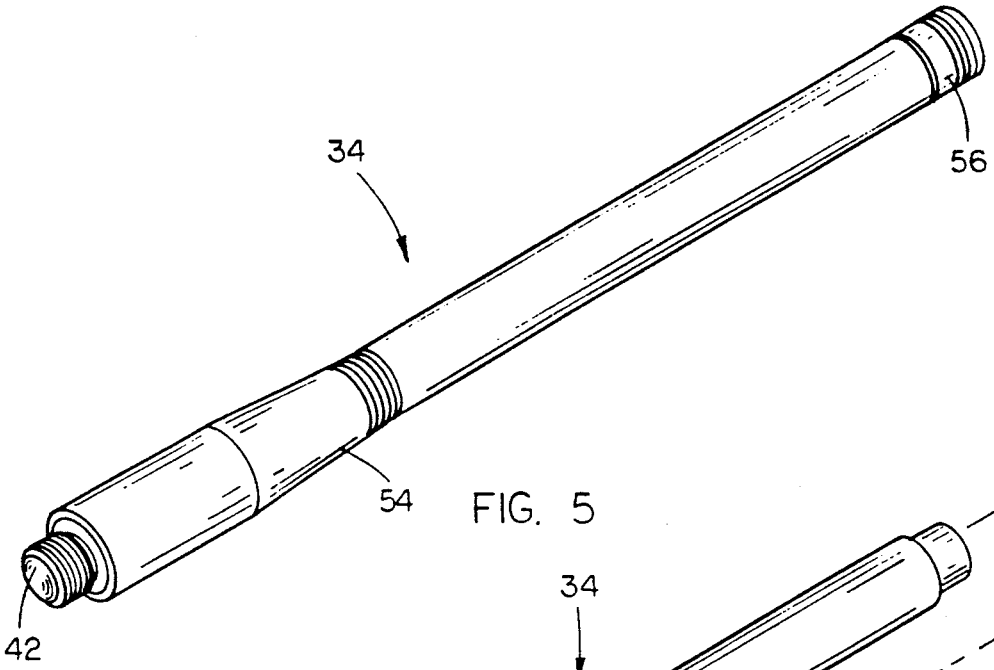
FIG. 5 is a perspective view of a modified form of the antenna.
Figure 6:
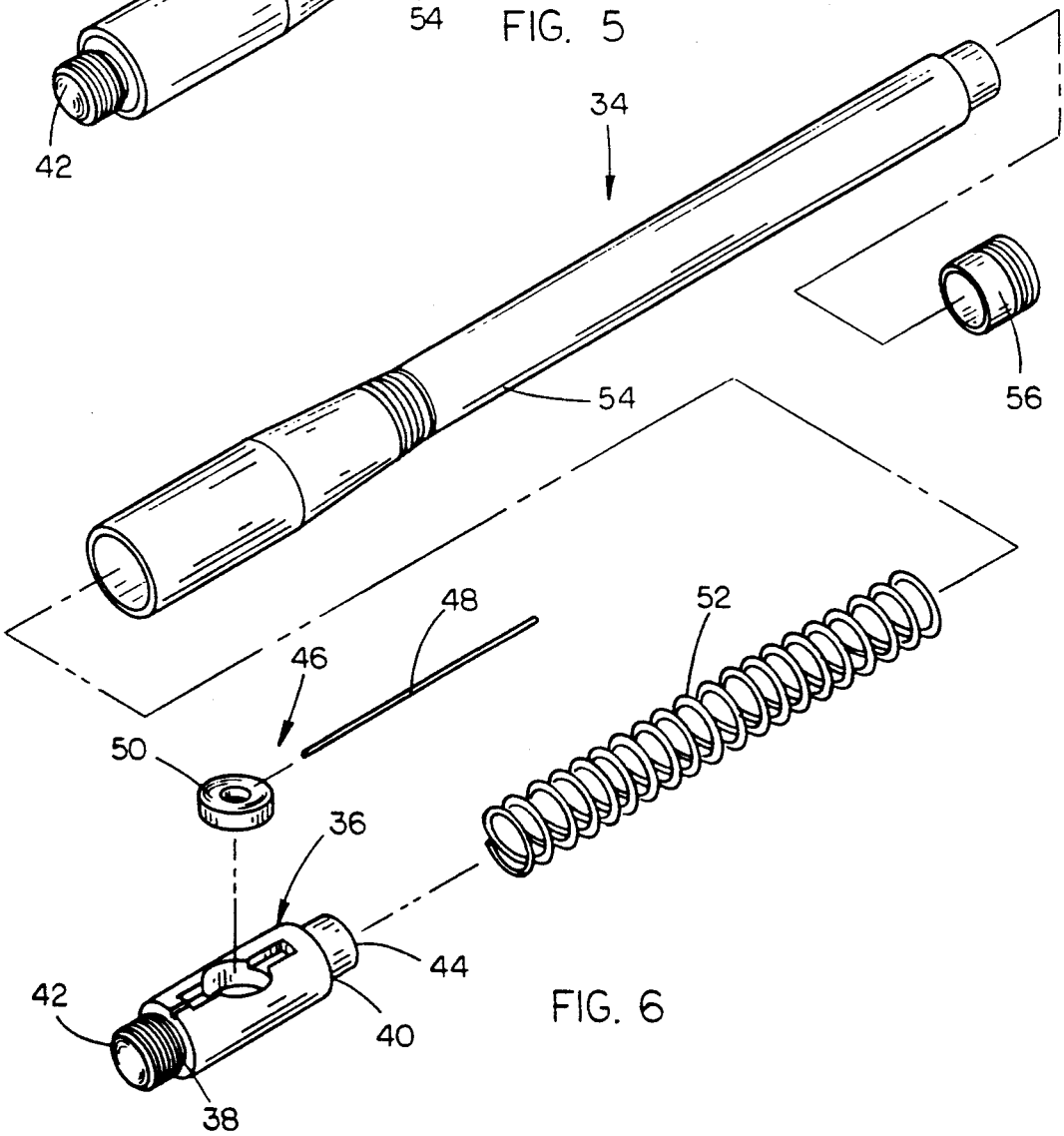
FIG. 6 is an exploded perspective view of the antenna of FIG. 5.
Figure 9:
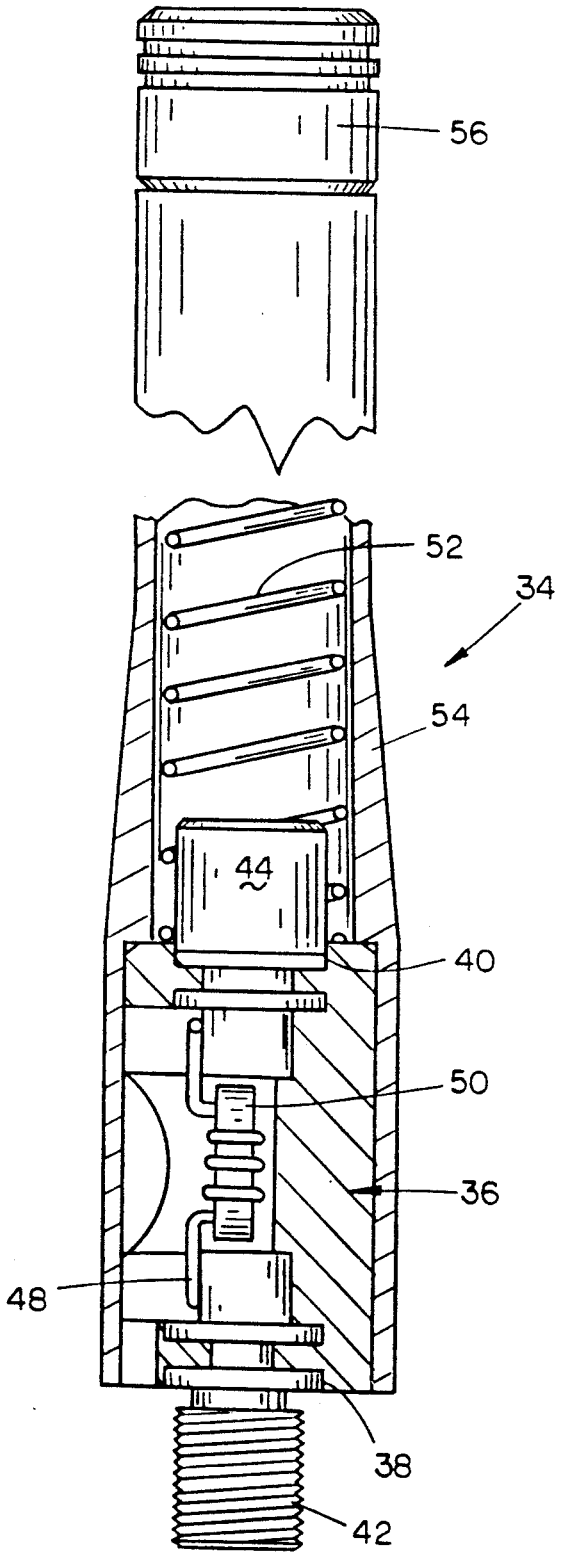
FIG. 9 is a longitudinal sectional view of the antenna of FIG. 5.

In FIGS. 5, 6, and 9, the numeral 34 refers to another embodiment of the antenna. Antenna 34 includes a hollow housing 36 having open ends 38 and 40. Connector 42 is mounted in the open end 38 of housing 36 while a conductive insert 44 is mounted in the other end of housing 36. Inductor 46 is mounted in the interior of housing 38 and includes a conductive wire 48 and a ferromagnetic toroid 50 with the conductor wire 48 being wrapped around the toroid 50 a predetermined number of times. One end of conductor wire 48 is soldered or otherwise secured to the inner end of the connector 42 as seen in FIG. 9. The other end of wire 48 is soldered or otherwise connected to the insert 44 as also seen in FIG. 9. Radiator 52 consists of a helical wound coil of steel wire which is copper plated and which has a wide pitch to contribute to bandwidth and to reduce capacitive reactance. Sheath 54 embraces the radiator 52 and the housing 36 as seen in FIG. 9 and is secured to the housing 36 by a suitable adhesive. Cap 56 is secured to the end of sheath 54 by a suitable adhesive or the like. The antenna is at DC ground, through its connection to the radio which contributes to noise reduction. The self-shielding characteristics of the toroid reduces undesired frequencies thus reducing intermodulation and harmonics.

The antenna 34 of FIGS. 5, 6 and 9 functions in the same manner as the antenna 10 of FIGS. 1–4. RF energy from a frequency source of 136–174 $MH_z$ is applied to the connector 42.

Figure 7:
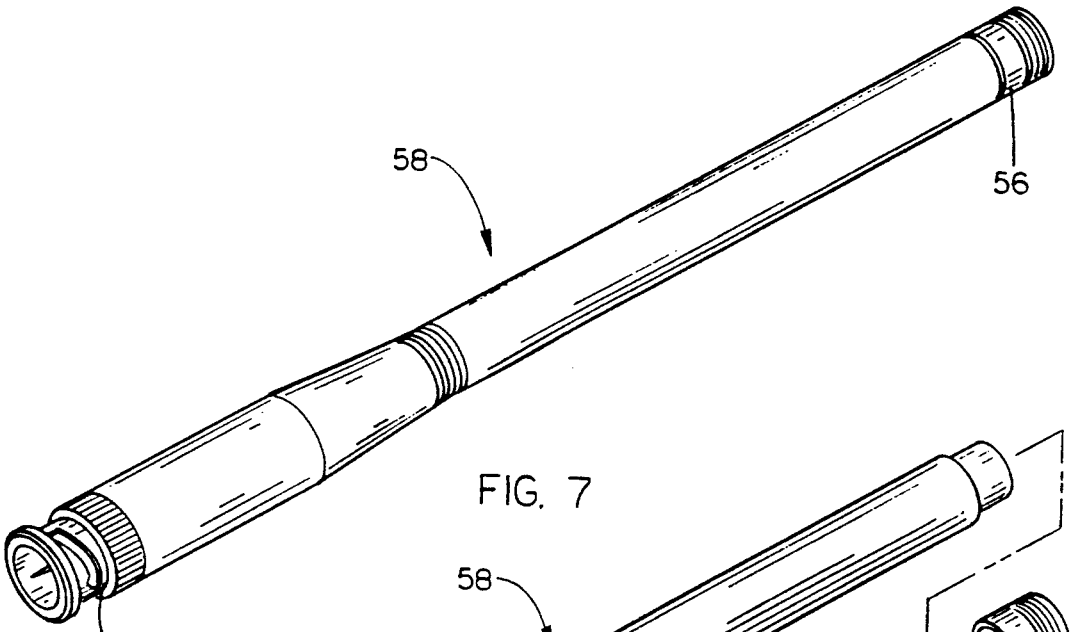
FIG. 7 is a perspective view of yet another modified form of the antenna.
Figure 8:
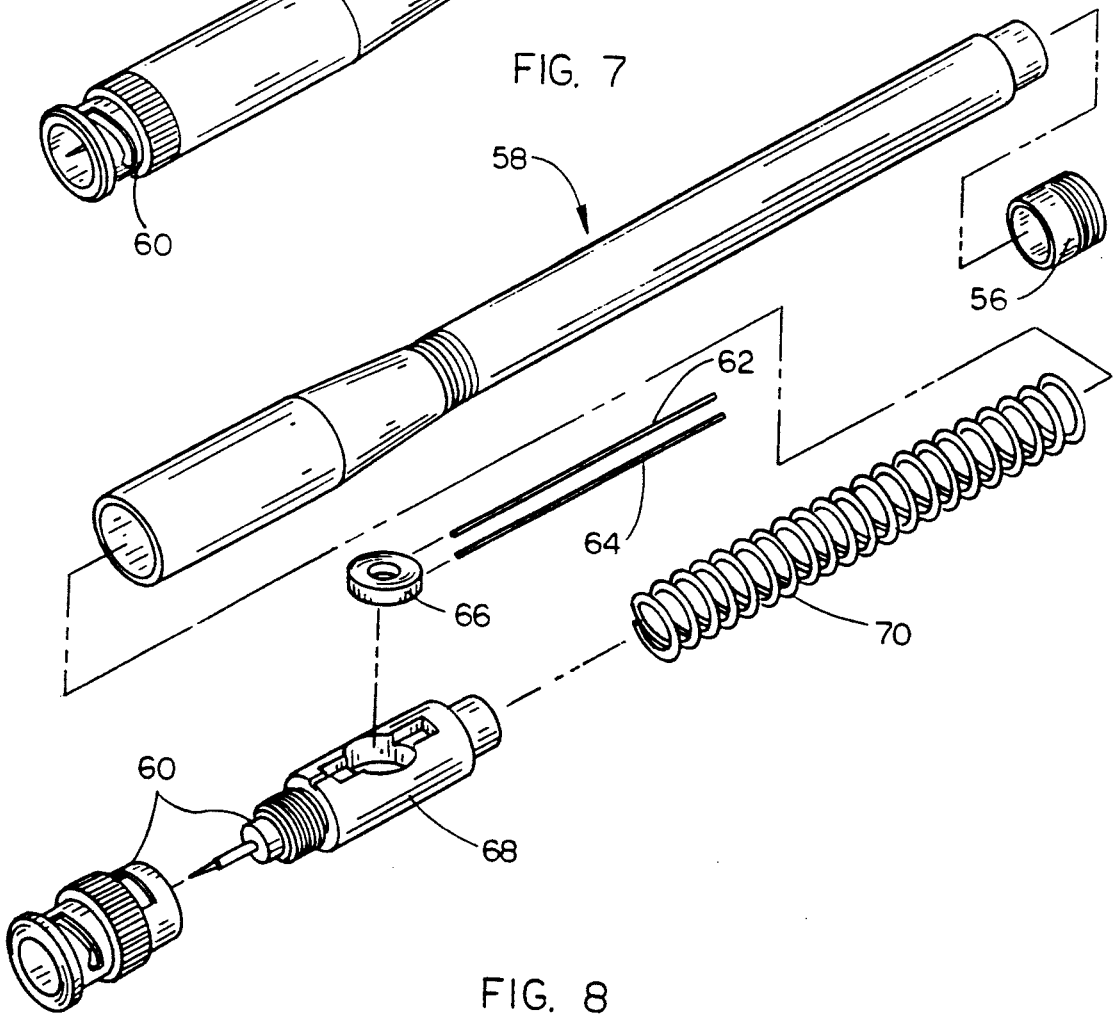
FIG. 8 is an exploded perspective view of the antenna of FIG. 7.
Figure 10:
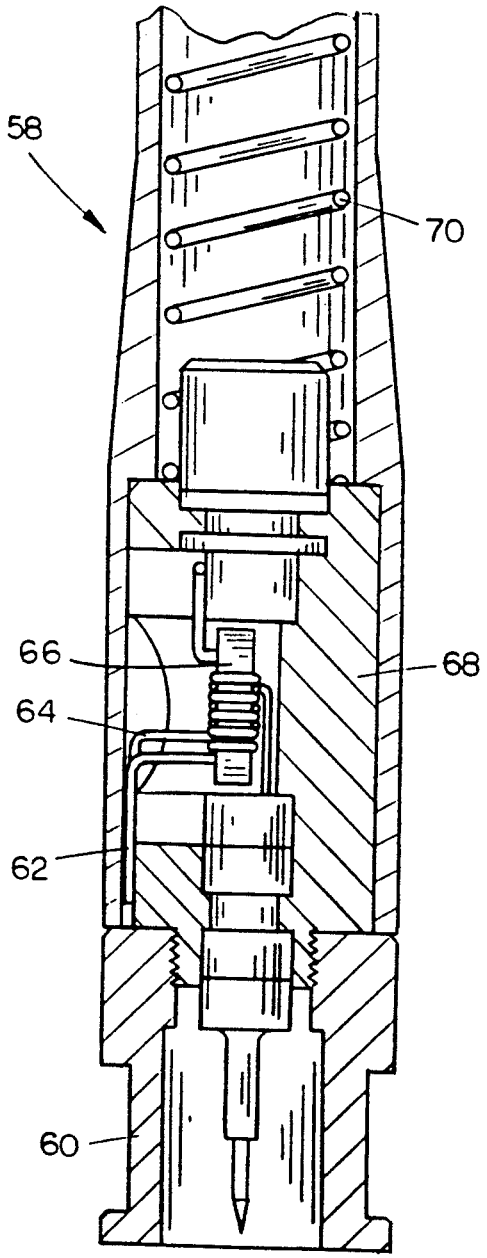
FIG. 10 is a longitudinal sectional view of the antenna of FIG. 7.

In FIGS. 7, 8 and 10, the numeral 58 refers to still another modified form of the antenna. The antenna 58 is essentially the same as antenna 34 except that the modified connector 60 is employed and a pair of conductor wires 62 and 64 are utilized in the transformer. Conductors 62 and 64 are looped through the toroid 66 providing a primary and secondary winding. Conductor wire 62 is wrapped around the toroid 66 three turns while conductor 64 is wrapped around the toroid four turns. Toroid 50 is not a ferromagnetic toroid but is a powdered iron toroid, made from a powdered iron material. Sheath 54 is secured to the housing 68 so as to enclose housing 68 and radiator 70.

Figure 11:
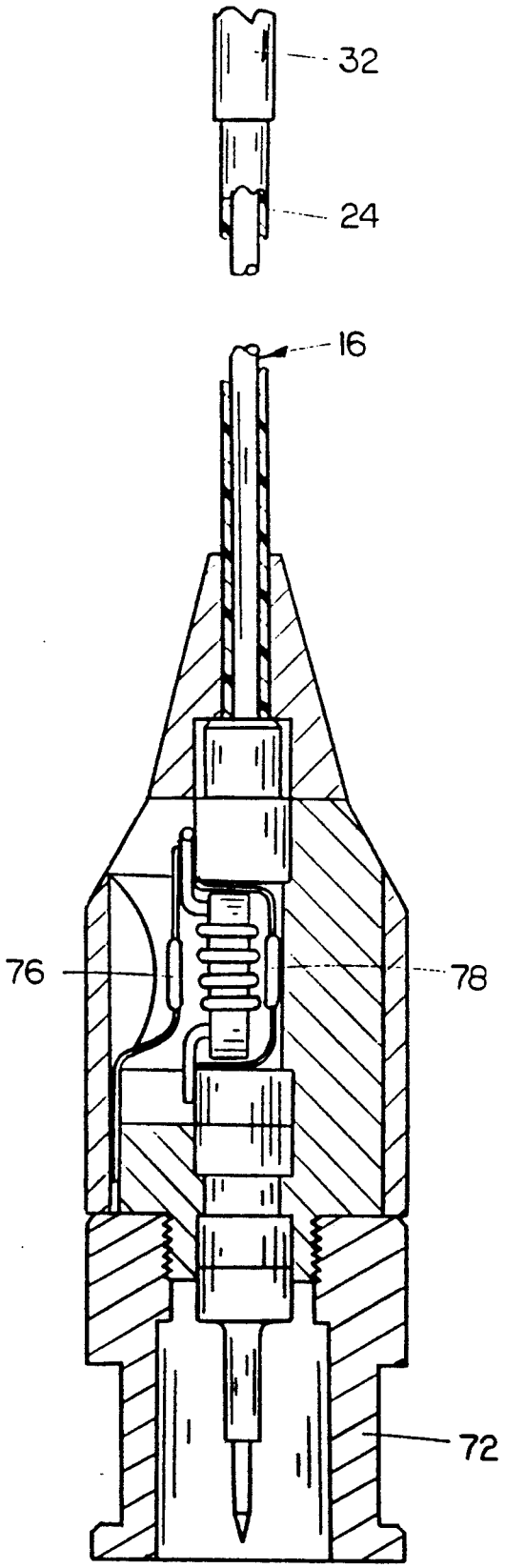
FIG. 11 is a longitudinal sectional view of yet another form of the antenna.

FIG. 11 illustrates a modified form of the antenna which consists of a BNC or TNC conductor 72, a powdered iron toroid core 74 with four turns of No. 26 enamel wire wound therearound. A pair of capacitors 76 and 78 are utilized as illustrated in FIG. 11 to form a broadband tuned circuit. The core, winding and tuned network forms the broadbanding circuit capable of accommodating a frequency range of 300–500 $MH_z$.

Thus it can be seen that a novel broadband antenna has been provided which reduces the need for several different antennas to cover the desired frequency ranges. The toroid core of the antenna offers a high inductance to the circuit thereby requiring only a few coil turns for a broad bandwidth circuit. The core enforces the electromagnetic energy and circuit inductance with the radiator contributing to bandwidth and reduce capacitive reactance. The self-shielding characteristics of the toroid reduces undesired frequencies thus reducing intermodulation and harmonics.

It can therefore be seen that the antenna of this invention accomplishes at least all of its stated objectives.

I claim:

1. A broadband antenna for use with a source of RF energy, comprising:

a connector having first and second ends, said first end of said connector being adapted for connection to said source of RF energy, a hollow housing having open first and second ends, said first end of said housing embracing said second end of said connector, a conductive insert mounted in said second end of said housing and having a cylindrical end portion protruding therefrom, an elongated radiator comprising a helical wound coil having one end mounted on said cylindrical end portion of said insert, an inductor in said housing interconnecting said connector and said insert, said inductor including a toroid having a conductor wire wrapped therearound a predetermined number of turns, said conductor wire being in direct communication from said toroid to said connector and from said toroid to said insert, capacitor means connected between said connector and said insert to form a broadband tuned circuit, and an elongated hollow sheath embracing said housing, said radiator, and at least a portion of said connector.

2. The broadband antenna of claim 1, wherein said toroid is formed of a powdered iron material.

* * * * *